US006178928B1

(12) United States Patent
Corriveau

(10) Patent No.: US 6,178,928 B1
(45) Date of Patent: Jan. 30, 2001

(54) INTERNAL COMBUSTION ENGINE TOTAL COOLING CONTROL SYSTEM

(75) Inventor: Anthony F.J. Corriveau, Pembroke (CA)

(73) Assignee: Siemens Canada Limited, Mississauga (CA)

( * ) Notice: Under 35 U.S.C. 154(b), the term of this patent shall be extended for 0 days.

(21) Appl. No.: 09/328,824

(22) Filed: Jun. 9, 1999

Related U.S. Application Data

(60) Provisional application No. 60/089,688, filed on Jun. 17, 1998.

(51) Int. Cl.[7] ..... F01P 7/02
(52) U.S. Cl. ..... 123/41.12; 123/41.44
(58) Field of Search ..... 123/41.1, 41.44, 123/41.12

(56) References Cited

U.S. PATENT DOCUMENTS

| | | | |
|---|---|---|---|
| 1,284,177 | 11/1918 | Camden . | |
| 1,576,833 | 3/1926 | Larsen . | |
| 1,911,522 | 5/1933 | McIntyre . | |
| 1,941,587 | 1/1934 | Stone et al. | 257/187 |
| 1,992,795 | 2/1935 | Young | 257/137 |
| 2,162,152 | 6/1939 | Wulle | 257/244 |
| 2,286,398 | 6/1942 | Young | 257/259 |
| 2,420,436 | 5/1947 | Mallory | 123/178 |
| 2,606,539 | 8/1952 | Field, Jr. | 123/41.29 |
| 2,631,543 | 3/1953 | Richmond | 103/87 |
| 2,697,986 | 12/1954 | Meagher, Jr. | 103/87 |
| 2,953,993 | 9/1960 | Strickland et al. | 103/87 |
| 3,096,818 | 7/1963 | Evans et al. | 165/111 |
| 3,164,096 | 1/1965 | Hallerback | 103/87 |
| 3,444,845 | 5/1969 | Scheiterlein | 123/41.82 |
| 3,719,436 | 3/1973 | McFarlin | 417/356 |
| 3,795,274 | 3/1974 | Fieni | 165/122 |

(List continued on next page.)

FOREIGN PATENT DOCUMENTS

| | | |
|---|---|---|
| 4117214A1 | 12/1992 | (DE) . |
| 0 584 850A1 | 3/1994 | (EP) . |
| 2 455 174 | 11/1980 | (FR) . |
| WO 79/00782 | 10/1979 | (JP) . |

OTHER PUBLICATIONS

Xu et al.—A Simulation Study of a Computer Controlled Cooling System for a Diesel Powered Truck, SAE Technical Paper Series—841711, Truck and Bus Meeting & Exposition Dearborn, Michigan, Dec. 3–6, 1984.

Patent Abstracts of Japan vol. 095, No. 010, Nov. 30, 1995, JP 07 180554 A (Aisin Seiki Co Ltd), Jul. 18, 1995.

*Primary Examiner*—Willis R. Wolfe
*Assistant Examiner*—Katrina B. Harris

(57) ABSTRACT

An engine cooling system includes an engine 14; a radiator assembly including a radiator 16 and a fan 19 driven by an electric fan motor 21; a coolant circulation circuit 12 interconnecting the engine and the radiator for circulating coolant; a by-pass circuit 24 connected to the coolant circulation circuit so that coolant may by-pass the radiator; an electrically powered variable speed coolant pump 28 disposed in the coolant circulation circuit to pump coolant through the coolant circulation circuit; control valve structure 26 constructed and arranged to control mass flow of coolant through the radiator; an engine temperature sensor 54 to detect a temperature of engine coolant; a radiator temperature sensor 58 to detect a temperature of air exiting the radiator or a temperature of coolant at an outlet of the radiator, and a controller 36 operatively connected with the electric fan motor, the coolant pump, the control valve structure, the engine temperature sensor, and the radiator temperature sensor. The controller selectively controls (1) the control valve structure, (2) operation of the coolant pump based on signals received from the engine temperature sensor and (3) operation of the electric fan motor based on a signal received from the radiator temperature sensor, thereby controlling an operating temperature of the engine to approach a target operating temperature. Methods of cooling an engine are also provided.

29 Claims, 1 Drawing Sheet

U.S. PATENT DOCUMENTS

| | | | |
|---|---|---|---|
| 3,999,598 | 12/1976 | Fehr et al. | 165/42 |
| 4,061,187 | 12/1977 | Rajasekaran et al. | 165/107 |
| 4,333,797 | 6/1982 | Nishizawa | 376/210 |
| 4,369,738 | 1/1983 | Hirayama | 123/41.1 |
| 4,381,736 | 5/1983 | Hirayama | 123/41.1 |
| 4,423,705 | 1/1984 | Morita et al. | 123/41.02 |
| 4,434,749 | 3/1984 | Morita et al. | 123/41.02 |
| 4,459,087 | 7/1984 | Barge | 417/356 |
| 4,461,246 | 7/1984 | Clemente | 123/41.12 |
| 4,475,485 | 10/1984 | Sakakibara et al. | 123/41.05 |
| 4,480,551 | 11/1984 | LoFiego | 102/245 |
| 4,489,680 | 12/1984 | Spokas et al. | 123/41.05 |
| 4,539,942 | 9/1985 | Kobayashi et al. | 123/41.1 |
| 4,545,333 | 10/1985 | Nagumo et al. | 123/41.02 |
| 4,546,742 | 10/1985 | Sturges | 123/41.05 |
| 4,557,223 | 12/1985 | Gueyen | 123/41.12 |
| 4,567,858 | 2/1986 | Hayashi | 123/41.13 |
| 4,580,531 | 4/1986 | N'Guyen | 123/41.1 |
| 4,615,599 | 10/1986 | Kataoka et al. | 354/415 |
| 4,616,599 | 10/1986 | Taguchi et al. | 123/41.1 |
| 4,620,509 | 11/1986 | Crofts | 123/41.1 |
| 4,685,513 | 8/1987 | Longhouse et al. | 165/121 |
| 4,688,998 | 8/1987 | Olsen et al. | 417/356 |
| 4,691,668 | 9/1987 | West | 123/41.12 |
| 4,702,306 | 10/1987 | Herzog | 165/36 |
| 4,726,324 | 2/1988 | Itakura | 123/41.1 |
| 4,726,325 | 2/1988 | Itakura | 123/41.1 |
| 4,744,335 | 5/1988 | Miller | 123/41.1 |
| 4,753,284 | 6/1988 | Krause et al. | 165/11.1 |
| 4,759,316 | 7/1988 | Itakura | 123/41.08 |
| 4,768,484 | 9/1988 | Scarselletta | 123/41.21 |
| 4,876,492 | 10/1989 | Lester et al. | 318/254 |
| 4,930,455 | 6/1990 | Creed et al. | 123/41.1 |
| 4,961,404 | 10/1990 | Itakura et al. | 123/41.31 |
| 5,000,257 | 3/1991 | Shinmura | 165/140 |
| 5,002,019 | 3/1991 | Klaucke et al. | 123/41.49 |
| 5,021,185 | 6/1991 | Mustakallio | 252/142 |
| 5,036,803 | 8/1991 | Nolting et al. | 123/41.1 |
| 5,046,554 | 9/1991 | Iwasaki et al. | 165/140 |
| 5,079,488 | 1/1992 | Harms et al. | 318/471 |
| 5,121,788 | 6/1992 | Carollo | 165/47 |
| 5,201,285 | 4/1993 | McTaggart | 123/41.31 |
| 5,215,044 | 6/1993 | Banzhaf et al. | 123/41.29 |
| 5,219,016 | 6/1993 | Bolton et al. | 165/41 |
| 5,242,013 | 9/1993 | Couetoux et al. | 165/121 |
| 5,269,367 | 12/1993 | Susa et al. | 165/41 |
| 5,363,905 | 11/1994 | Rhiel et al. | 165/1 |
| 5,390,632 | 2/1995 | Ikebe et al. | 123/41.02 |
| 5,522,457 | 6/1996 | Lenz | 165/121 |
| 5,537,956 | 7/1996 | Rennfeld | 123/41.29 |
| 5,577,888 | 11/1996 | Capdevila | 415/210.1 |
| 5,597,038 | 1/1997 | Potier | 165/121 |
| 5,619,957 | 4/1997 | Michaels | 123/41.44 |
| 5,660,149 | 8/1997 | Lakerdas et al. | 123/41.44 |
| 5,724,924 | 3/1998 | Michaels | 123/41.12 |
| 5,758,716 | 6/1998 | Shibata | 165/41 |
| 5,845,612 | 12/1998 | Lakerdas | 123/41.44- |

INTERNAL COMBUSTION ENGINE TOTAL COOLING CONTROL SYSTEM

This application claims the benefit of U.S. Provisional Application No. 60/089,688, filed on Jun. 17, 1998, the content of which is hereby incorporated into the present specification by reference.

BACKGROUND OF THE INVENTION

1. Field of the Invention

This invention relates to a cooling control system for an internal combustion engine and more particularly to a total cooling control system employing an electric water pump, various temperature sensors, a radiator flow control valve, a radiator fan motor and a controller to control the cooling system to maintain an engine operating temperature within a narrow range around a target temperature.

2. Description of Related Art

Conventional internal combustion cooling systems generally employ a mechanical water pump which is operated based on engine speed, a thermostat, and a radiator to maintain the engine temperature within a safe operating temperature range. However, since the speed of the mechanical water pump is directly related to the engine rpm, at low engine rpm and high engine load, the speed of the mechanical water pump may limit the ability of the cooling system to dissipate the required heat from the engine. This condition can lead to the temperature of the engine exceeding the controllable range of the thermostat. In addition, at high engine rpm and low load conditions, the capacity of the water pump may exceed the necessary cooling requirements and energy may be wasted due to circulating excess fluid. This wasted energy represents a potential fuel savings.

With the conventional mechanical water pump and thermostat, generally the set point for the engine operating temperature is fixed. With a fixed operating temperature, the cooling system may not be tuned to optimize emission and power based on engine load.

Accordingly, a need exists to provide a total cooling control system to maintain the engine operating temperature within a narrow range around a target temperature with the engine target temperature and mass flow rate through the engine being a direct function of the he at released and an indirect function of engine load.

SUMMARY OF THE INVENTION

An object of the present invention is to fulfill the need referred to above. In accordance with the principles of the present invention, this objective is obtained by providing an engine cooling system including an engine; a radiator assembly including a radiator and a fan driven by an electric fan motor, a coolant circulation circuit interconnecting the engine and t he radiator for circulating coolant; a by-pass circuit connected to the coolant circulation circuit so that coolant may by-pass the radiator; an electrically powered variable speed coolant pump disposed in the coolant circulation circuit to pump coolant through the coolant circulation circuit; control valve structure constructed and arranged to control mass flow of coolant through the radiator; an engine temperature sensor to detect a temperature of engine coolant; a radiator temperature sensor to detect a temperature of air exiting the radiator or a temperature of coolant at an outlet of the radiator; and a controller operatively connected with the electric fan motor, the coolant pump, the control valve structure, the engine temperature sensor, and the radiator temperature sensor. The controller selectively controls (1) the control valve structure, (2) operation of the coolant pump based on signals received from the engine temperature sensor and (3) operation of the electric fan motor based on a signal received from the radiator temperature sensor, thereby controlling an operating temperature of the engine to approach a target operating temperature as a direct function of heat released, without monitoring actual speed or load of the engine.

In accordance with another aspect of the invention, a method of controlling an operating temperature of an engine is provided. The engine has a cooling system including a radiator assembly including a radiator and a fan driven by an electric fan motor; a coolant circulation circuit interconnecting the engine and the radiator for circulating coolant; a by-pass circuit connected to the coolant circulation circuit so that coolant may by-pass the radiator; an electrically powered variable speed coolant pump disposed in the coolant circulation circuit to pump coolant through the coolant circulation circuit; control valve structure constructed and arranged to control mass flow of coolant through the radiator; an engine temperature sensor to detect a temperature of engine coolant; a radiator temperature sensor to detect a temperature of air exiting the radiator or a temperature of coolant at an outlet of the radiator; and controller operatively connected the electric fan motor, the coolant pump, the control valve structure, the engine temperature sensor, and the radiator temperature sensor. The method includes determining the temperature of engine coolant and comparing the coolant temperature with a target engine coolant temperature. Based on a difference between the coolant temperature and the target engine coolant temperature, the control valve structure is operated and a speed of the coolant pump is controlled to control a mass flow rate of coolant though the radiator, thereby adjusting the operating temperature of the engine, without determining engine load and speed. An actual temperature of air exiting the radiator or of coolant at an outlet of the radiator is determined and compared to a target temperature. Based on a difference between the actual temperature and the target temperature, a speed of the electric fan motor is controlled to improve thermal performance of the radiator.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
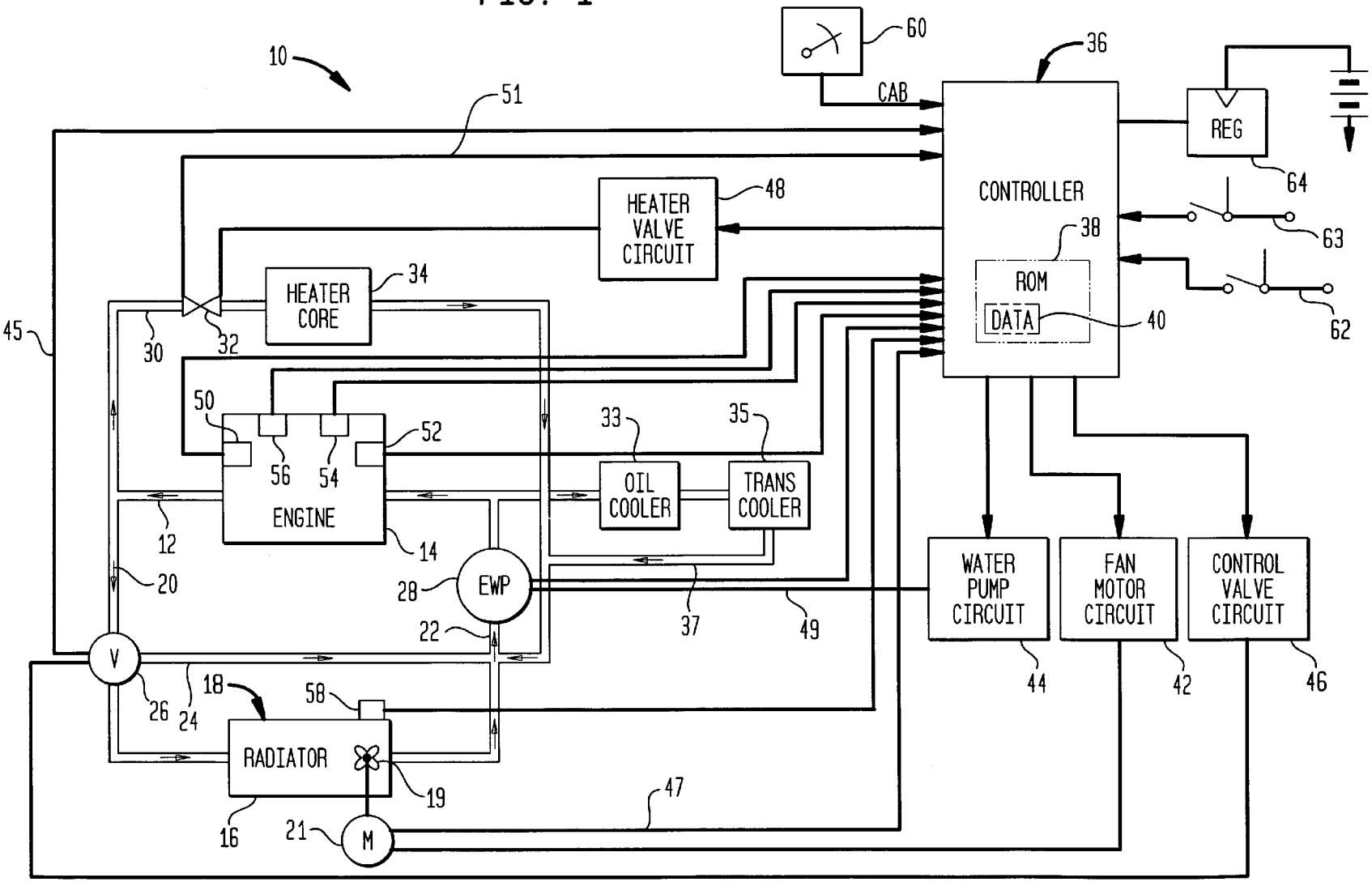
FIG. 1 is a schematic illustration of a total cooling system provided in accordance with the principles of the present invention.

Referring to FIG. 1, an internal combustion total cooling system is shown schematically, generally indicated 10, provided in accordance with the principles of the present invention. The total cooling system 10 includes a cooling water or coolant circulation circuit 12 constructed and arranged to connect an internal combustion engine 14 with a radiator 16 of a radiator assembly, generally indicated at 18. The cooling water circulation circuit 12 includes a passage 20 interconnecting an outlet of the engine 14 and an inlet of the radiator 16, and a passage 22 interconnecting an outlet of the radiator 16 and an inlet of the engine 14. The passages 20 and 22 are interconnected via a by-pass circuit 24 so that under certain operating conditions, water or coolant may by-pass the radiator 16. The radiator assembly 18 includes the radiator 16, a fan 19, and an electric motor 21 to drive the fan 19.

Control valve structure 26 is disposed in the cooling water circulation circuit 12 to control the mass flow of water though the radiator 16. In the illustrated embodiment, the control valve structure 26 is disposed in the passage 20 at a junction with the by-pass circuit 24. It can be appreciated that the control valve structure 26 can be located at a juncture of passage 22 and bypass circuit 24. In the illustrated embodiment, the control valve structure 26 is an electrically actuated, three-way diverter valve which is continuously variable in opening degree. Alternatively, the control valve structure 26 may comprise a pair of electrically actuated valves, such as butterfly valves. One of the valves controls flow through the radiator 16 and the other valve controls flow through the by-pass circuit 24. The butterfly valve in the by-pass circuit is optional.

An electrically operated, variable speed water pump (EWP) 28 is provided in the passage 22 to pump water or other coolant through the system 10.

A heater core circuit 30 is connected to the cooling water circuit 12. A heater valve 32 is disposed upstream of a heater core 34 in the heater circuit 30. As shown by the arrows in FIG. 1, when the heater valve 32 is at least partially open, water will pass through the heater valve 32 and heater core 34 and will return to the electric water pump 28.

An optional oil cooler 33 and an optional transmission cooler/warmer 35 may be connected, via auxiliary circuit 37, to the cooling water circulation circuit 12.

A controller, generally indicated at 36, is provided to control operation of the electric water or coolant pump 28, the fan motor 21, the control valve 26 and heater valve 32. The controller 36 may be, for example, a Siemens C504 8 Bit CMOS microcontroller. The controller 36 includes read only memory (ROM) 38 which stores the control program for the controller 36. The ROM also stores certain data 40 for cooling system operation such as look-up tables for the change in target engine temperatures $\Delta T$ (which is the difference between a target outlet engine temperature and a target inlet engine temperature), target engine temperatures as a function of engine load, control valve structure index, control valve structure position, initial water pump rpm index, water pump pulse width modulation (PWM) setting, target radiator temperature and target engine oil temperature, the function of which will become apparent below.

Thus, the controller 36 operates under program control to develop output signals for the control of various components of the cooling system 10. A fan motor speed signal from the controller 36 is sent to a fan motor speed control circuit 42 which, in turn, is connected to the fan motor 21. A water pump speed control signal from the controller 36 is sent to a water pump speed control circuit 44 which, in turn, is connected to the electric water pump 28. A control valve position signal from the controller 36 is sent to a control valve position control circuit 46 which, in turn, is connected to the control valve 26. Finally, a heater valve position signal from the controller 36 is sent to a heater valve position control circuit 48 which, in turn, is connected to the heater valve 32.

Feedback via line 45 is provided from the control valve structure 26 to the controller 36 to indicate to the controller a present position of the control valve structure 26. Feedback via line 47 is provided from the fan motor 21 to the controller 36 to indicate to the controller the present fan motor rpm. Feedback is provided via line 49 from the electric water pump 28 to the controller 36 to indicate to the controller the present water pump rpm. Finally, feedback is provided via line 51 from the heater valve 32 to the controller to indicate to the controller the preset position of the heater valve 32.

Connected to the controller 36 is an engine outlet water temperature sensor 50 for detecting the engine outlet water temperature (Teng,out), an engine inlet water temperature sensor 52 for detecting the engine inlet water temperature (Teng,in), an engine oil temperature sensor 54 for detecting the engine oil temperature (Toil), an engine knock sensor 56 for detecting engine knock (Knock), an exit air temperature sensor 58 for determining a temperature of air (Tair) exiting the radiator 16. Alternatively, sensor 58 may be disposed so as to measure a temperature of coolant at an outlet of the radiator 16. Further, in the broadest aspects of the invention, only one engine coolant temperature sensor need be provided (either sensor 50 or sensor 52). In this case, the controller 36 can calculate or estimate the missing temperature.

Most cars today include an oil temperature sensor and a knock sensor. In this case the controller would communicate with the ECU of the vehicle to obtain the knock and oil temperature data.

For heater control purposes, a position sensor for the heater temperature control lever 60 supplies an input signal to the controller 36. In addition, a conductor to the engine ignition switch 62 supplies an input signal (FenginOn) to the controller 36 when the ignition is on. Furthermore, an A/C high pressure switch 63 is associated with the controller 36 so as to determine when the switch 63 is on or off, the function of which will explained more fully below.

The vehicle battery supplies electrical power to the controller 36. The negative battery terminal is connected to ground and the positive battery terminal is connected through a voltage regulator 64 to the controller 36.

FIG. 1 illustrates one embodiment of the mechanical component configuration of a total cooling system of the invention. It can be appreciated that other configurations may be employed such as, for example, the configurations depicted in U.S. patent application Ser. No. 09/105,634, entitled "Total Cooling Assembly For A Vehicle Having An Internal Combustion Engine", the content of which is hereby incorporated into the present specification by reference. Thus, in accordance with the invention, the controller 36 controls any valves associated with the radiator, bypass circuit and heater core, and would control the operation of the electric water pump(s).

From a systems point of view, the engine 14 is the primary source of heat while the radiator 16 is the primary element to dissipate heat. The bypass circuit 24 and heater core 34 act primarily to divert coolant past the radiator 16. The electric water pump 28 controls the system pressure drop; hence for a given valve configuration, the water pump 28 controls the total mass flow rate of the coolant through the system 10. The control valve structure 26 controls the proportion of coolant which is directed through the radiator 16 and in conjunction with the heater valve 32, may restrict the total flow through the engine 14. During cold start condition, the control valve structure 26 restricts the coolant flow through the by-pass circuit 24 to reduce the total flow rate through the engine below that normally obtained with the minimum rpm of the water pump 28. Under this condition, flow to the radiator 16 is prevented. At the end of cold start, the by-pass circuit 24 is open and a port to the radiator 16 is still fully closed. The heater valve 32 is opened when heat to the vehicle cabin is required. During cold start, coolant flow to the heater core 34 may be delayed by a few seconds or a few minutes to facilitate quicker engine warm-up. Under maximum load conditions, the heater valve 32 may be closed to increase the system pressure and hence the mass flow rate through the radiator 16.

The fan 19 of the radiator assembly 18 affects the thermal capacity of the air side of the radiator 16 and hence affects the outlet temperature of the coolant from the radiator 16.

With regard to the engine, the heat released to the coolant from the engine is a function of engine load and speed. A heat balance on the coolant side of the engine, $Q_{eng}$ is given by:

$$Q_{eng}=m\ Cp\ \Delta T_{eng} \tag{1}$$

where m is the coolant mass flow rate through the engine, Cp is the heat capacity of the coolant and $\alpha T_{eng}$ is given by:

$$\Delta T_{eng}=T_{eng,out}-T_{eng,in} \tag{2}$$

where the temperatures refer to the coolant outlet and inlet temperatures respectively. One of the controller's primary objectives is to manage the thermal stress on the engine by regulating the change in temperature across the engine. This is done by ensuring that $\Delta T_{eng}$ is kept within a safe range. Equation 1 demonstrates that if $\Delta T_{eng}$ is kept constant, the only variable left to balance the heat generated by the engine is m, the mass flow rate of coolant through the engine. For centrifugal pumps:

$$m\alpha RPM_{pump} \tag{3}$$

If the positions of the control valve structure 26 and the heater valve 32 are considered to be fixed, then, under this condition, the hydraulic resistance of the cooling system is also fixed. Thus, to first order of magnitude, the mass flow rate through the system is directly proportional to the speed of the electric water pump 28. This suggests that the speed of the water pump 28 may be used to adjust the temperature rise through the engine 14. However, the adjustment need not be based on water pump speed, but can be based on a duty cycle to a pulse width modulated (PWM) controller, with pump speed being used as a feedback variable. This would ensure that the speed of the water pump 28 would not fall below a minimum stall pump speed, and it would facilitate obtaining the maximum water pump speed obtainable from the available alternator voltage.

With regard to the radiator assembly 18, the heat rejected by the radiator 16 is described by:

$$Q_{rad}=m_{rad}\ Cp\ \Delta T_{rad} \tag{4}$$

where $\Delta T_{rad}$ is the temperature drop of the coolant through the radiator 16 and $m_{rad}$ is the coolant mass flow through the radiator. The actual temperature drop in the fluid is a function of the performance of the radiator 16, and again to first order of magnitude, the mass flow rate of the coolant through the radiator controls the total amount of heat which can be rejected. The amount of heat rejected by the radiator 16 will determine the equilibrium system temperature. For the algorithm of the preferred embodiment, the engine inlet temperature was selected as the control temperature to represent the cooling system temperature. Thus, the mass flow rate of coolant through the radiator 16 is used to adjust the engine operating temperature.

With regard to the radiator fan 19. the maximum heat rejected from the radiator 16 can be expressed as:

$$Q_{rad,max}=C_{min}\Delta T_{max} \tag{5}$$

where $C_{min}$ is the minimum thermal capacity of the two fluids and is given by:

$$C_{\min} = \mathrm{MIN}\left|\begin{array}{l}\dot{m}_{(coolant)}C_{p(coolant)}\\ \dot{m}_{(air)}C_{p(air)}\end{array}\right. \tag{6}$$

and $\Delta T_{max}$ is the maximum temperature difference of the two fluids and is often called the approach difference. The controller 36 cannot modify the approach temperature, however, the controller 36 can affect the thermal capacity of the air side which under large radiator coolant flow rates, is equal to $C_{min}$. The easiest indication that the thermal capacity of the air side is being saturated, is to measure the exit temperature of the air from the radiator 16 or the temperature of the coolant at the outlet of the radiator 16. If the exit air temperature exceeds a minimum performance value, the mass flow rate of the air should be increased. Thus, the speed of the electric fan motor 21 is used to improve the thermal performance of the radiator 16 when the air side thermal capacity is limiting the heat rejection of the radiator 16. By monitoring the radiator exit air temperature or coolant temperature at the outlet of the radiator 16, the controller 36 automatically accounts for any additional heat load due to an A/C condenser or charge air cooler.

There are conditions by which the speed of the electric water pump 28 required to maintain desired $\Delta T_{eng}$ will not provide sufficient coolant flow from the radiator 16 to protect the engine 14 from over heating. Under these conditions, the engine temperature must override the normal control of the electric water pump 28. In doing so, the electric water pump speed will be increased from that required to prevent thermal stress. The result is that the temperature rise through the engine will decrease and thus further reduce the thermal stress on the engine 14.

There are many reasons why the target engine temperature and temperature rise through the engine should be a function of engine load. However, it is not really engine load that is of concern; it is the magnitude of heat flux from the cylinders and the total thermal load on the cooling system that is of interest. Again, by examining Equations 1–3, it can be stated that the speed of the electric water pump 28 is directly related to the heat flux and heat release from the engine 14. Hence, the speed of the electric water pump 28 is an indirect measure of the total heat released and as far as the cooling system is concerned, is equivalent to monitoring the true engine load and speed.

In this manner, the target engine temperature ΔT and the desired mass flow rate through the engine can be an indirect function of engine load and a direct function of heat released by using the present electric water pump speed as an index or variable in the determination of the target temperatures.

The controller 36 simply monitors the engine oil temperature. The oil temperature is used to change the set point for the engine temperature. In most cases, this will result in further opening of the control valve structure 26 to increase flow through the radiator 16. Only when the control valve structure 26 is opened fully will the controller 36 increase the speed of the water pump 28 in response to engine temperature control and hence would shift the controller 36 from a normal mode to a pump override mode.

The maximum amount that the controller 36 is permitted to reduce the engine temperature is restricted and divided into several steps. The engine temperature is not reduced to the next step until the engine temperature has reached the new modified temperature and the controller confirms that the oil temperature has not been reduced sufficiently.

In a similar manner, if persistent knock is detected, the controller will reduce the engine temperature in an effort to eliminate thermal knock. The engine electronic control unit (ECU) (not shown) should be able to adjust the air fuel ratio and timing within two revolutions of the engine to eliminate knock. If knock persists for a longer period of time, the controller 36 assumes that the knock is thermally generated and would further open the control valve structure 26 to increase coolant flow through the radiator 16.

Both the oil and knock routines know what the other routines are doing and wait for the engine to achieve its new lower temperature before requesting any further reduction of engine temperature.

The control strategy as set forth above can be implemented using many different algorithms. For example, a full PID-type controller may be employed or a controller for the system of the invention can be an integral controller.

The controller 36 controls the operation of the control valve 26, the fan motor 21, the heater valve 32, and the electric water pump 28 in accordance with the above defined signals, Teng,out; Teng,in; Toil; Knock; Tair and FenginOn.

A start cycle is utilized to power the controller 36 and the electric water pump 28, to test sensors, and to preset valves 26 and 28 to an initial position. A typical start cycle in accordance with the invention is as follows:

START CYCLE

1. Wait for ignition key to be turned to on.
2. Power up controller 36.
3. Test sensors and feedback systems—no open circuits—read error codes and shut down system if a problem is detected and display warning/service or disable ignition if problem is serious.
4. Initialize program variables.
5. Preset valves 26 and 32.
6. Wait for engine start or go to #1 above if key is turned off.
7. Start electric water pump 28.
8. Go to MAIN CONTROL LOOP.

A main control loop is utilized to control the electric water pump 28 and air flow through the radiator 16 to control the temperature rise through the engine. A typical main control loop for the system is as follows:

MAIN CONTROL LOOP

1. Read all sensors—Engine Outlet Temperature (Teng, out), Engine inlet Temperature (Teng,in), Radiator Outlet temperature (Tair), Oil Temperature (Toil), Knock Signal (Knock) from ECU, High Pressure Switch 63 on A/C system and Ignition Sensor (FenginOn).
2. Check if engine is still running: if NO go to AFTERUN or else continue.
3. Calculate or modify Target Engine Temperature, Target Engine Temperature Rise ($\Delta T$ across the engine) through the use of a look-up table based on current water pump 28 speed (e.g., indirectly, engine load) as well as Oil Temperature (Toil) and Knock.
4. Determine water pump 28 speed and position of valve 26 using PID or some other method following the rules below:
   - If Actual Engine Temperature Rise>Target Engine Temperature Rise then INCREASE Total Coolant Flow Rate through the engine, or else, if Actual Engine Temperature Rise<Target Engine Temperature Rise then DECREASE Total Coolant Flow Rate Through the engine. (There are two ways to increase the coolant flow rate depending on the control mode of the control valve structure 26—in a radiator bypass mode, the radiator port is closed and the speed of the water pump 28 is fixed at its lowest speed and the bypass port is modulated from about 1/10 open to fully open to regulate coolant flow through the system. In a radiator mode, the bypass and radiator ports are modulated to control the flow split between the bypass and the radiator 16 and the speed of the water pump 28 is modulated to control the total coolant flow rate though the system.
   - If Engine Inlet Temperature (Teng,in)>Target Engine Inlet Temperature, then INCREASE Coolant Flow Rate to the radiator 16 or else, if Engine Inlet Temperature (Teng,in)<Target Engine Inlet Temperature, then DECREASE Coolant Flow Rate to the radiator 16.
   - If Radiator Outlet Temperature (Tair)>Target Radiator Temperature, then INCREASE air flow through the radiator 16 or else, if Radiator Outlet Temperature (Tair)<Target Radiator Temperature, then DECREASE air flow through the radiator 16.
   - If Engine Oil Temperature (Toil)>Target Engine Oil Temperature, then DECREASE the Target Engine Temperature or else if Engine Oil Temperature (Toil) <Target Engine Oil Temperature, then in small steps, INCREASE Target Engine Temperature up a value that would represent the original target engine temperature for the prevailing conditions.
   - If ECU indicates thermal knock, then DECREASE target engine temperature or else if knock condition ends, in small steps, INCREASE engine temperature to restore for target temperature without knock condition.
   - If A/C high pressure switch 63 is on, then INCREASE radiator fan 19 speed or else if A/C high pressure switch 63 is no longer on and radiator outlet temperature (Tair) is lower than required, then DECREASE radiator fan 19 speed.
5. Set valves 26, 32 and pump 28 speed with feedback control. Generate error codes if control elements are not responding correctly. Limit maximum engine power for "limp home" mode or shut down engine if required to safeguard engine.
6. Go to #1 above of Main Control Loop.

After the engine is turned-off, an After Run sequence is initiated to determine if the engine temperature is at an acceptable value. The following is a typical After Run sequence:

AFTER RUN

1. Open control valve structure 28 to fully open.
2. Close heater valve 32.
3. Adjust speed of pump 28 to after run speed.
4. Read temperature of engine.
5. If engine temperature OK then go to #8 below.
6. If ignition key off, then go to #4 of After run.
7. If engine started then initialize variables and go to #1 of Main Control Loop.
8. Turn-off pump 28.

9. Test functionality of control elements and store error codes.

10. Reset valves 26 and 32 to start position.

11. Go to #1 of Start Cycle.

The possible benefits of the of the total cooling system 10 of the invention include the ability to control engine temperature tightly, which means that the maximum temperature of the engine can be safely increased. With such control the engine may operate at a higher temperature so as to provide more efficient combustion of fuel. Better utilization of fuel results in lower emissions and increased fuel economy.

The electronically controlled cooling system of the invention provides adaptive engine temperature for optimized fuel economy, emissions or drivability depending on engine load and driving conditions or driving styles. The engine temperature is not fixed to a narrow band as is in a mechanical thermostat.

The high efficiency electric water pump pumps only the amount of fluid required when necessary in contrast to a mechanical water pump which pumps a fixed volume of fluid for a given engine rpm regardless if the fluid is required. In addition, the electronic water pump provides better cooling at low engine rpm since the maximum available flow is not restricted by engine rpm. Furthermore, the electric water pump provides potential energy savings at high engine rpm or highway driving conditions where there is a possibility of reducing the total coolant flow rate.

With electronically controlled engine temperature, the engine temperature can be adjusted to account for overheating of the engine oil, the thermal induced knock, or to optimize the performance of the engine or ancillary equipment.

With an electronically monitored engine warm-up, under all conditions, the controller can optimize the water pump and valve positions to maintain a maximum acceptable level of thermal metal stress and minimize the warm-up phase of the drive cycle. It is during this warm-up phase that a significant amount of emissions are produced.

The electronically controlled electronic water pump allows for an after run cycle to improve hot starts to reduce the chance of boiling during a hot soak condition.

The electronically controlled cooling system can monitor the performance of the electric water pump, valves, heat release for engine and cooling diagnostics.

Finally, computer control could be self-calibrating and self-learning.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An engine cooling system comprising:

an engine;

a radiator assembly including a radiator and a fan driven by a variable speed electric fan motor;

a coolant circulation circuit interconnecting said engine and said radiator for circulating coolant;

a by-pass circuit connected to said coolant circulation circuit so that coolant may by-pass said radiator;

an electrically powered variable speed coolant pump disposed in said coolant circulation circuit to pump coolant through said coolant circulation circuit;

control valve structure constructed and arranged to control mass flow of coolant through said radiator;

an engine temperature sensor to detect a temperature of engine coolant;

a radiator temperature sensor to detect a temperature indicative of a temperature of said radiator; and a controller operatively connected with said electric fan motor, said coolant pump, said control valve structure, said engine temperature sensor, and said radiator temperature sensor to selectively control (1) said control valve structure, (2) speed of said coolant pump based on signals received from said engine temperature sensor and (3) speed of said electric fan motor based on a signal received from said radiator temperature sensor, thereby controlling an operating temperature of said engine to approach a target operating temperature.

2. The cooling system according to claim 1, wherein said radiator temperature sensor is constructed and arranged to detect a temperature of air exiting said radiator.

3. The cooling system according to claim 1, wherein said radiator temperature sensor is constructed and arranged to detect a temperature of coolant at an outlet of said radiator.

4. The cooling system according to claim 1, wherein said engine temperature sensor monitors a temperature of coolant at an inlet of said engine.

5. The cooling system according to claim 1, wherein said engine temperature sensor monitors a temperature of coolant at an outlet of said engine.

6. The cooling system according to claim 1, further including a feedback circuit associated with said coolant pump to indicate to said controller a present speed of said coolant pump.

7. The cooling system according to claim 1, further including a feedback circuit associated with said electric fan motor to indicate to said controller a present speed of said electric fan motor.

8. The cooling system according to claim 1, further comprising:

a heater circuit connected to the coolant circulation circuit;

a heater core in said heater circuit; and a valve in said heater circuit to control flow of coolant through said heater core, said valve being operatively connected with said controller so that said controller may control said valve to control flow through said heater core.

9. The cooling system according to claim 1, wherein said controller is constructed and arranged to receive knock data so that said controller may control said control valve structure to increase flow through said radiator to reduce the engine temperature to eliminate knock.

10. The cooling system according to claim 1, further including a feedback circuit associated with said control valve structure to indicate to said controller a present position of said control valve structure.

11. The cooling system according to claim 1, wherein said controller is constructed and arranged to receive engine oil temperature data so that said controller may control said control valve structure to increase flow through said radiator to reduce the engine oil temperature.

12. The cooling system according to claim 1, further including a feedback circuit associated with said fan motor to indicate to said controller a present speed of said fan motor.

13. The cooling system according to claim 8, further including a feedback circuit associated with said valve in said heater circuit to indicate to said controller a present position of said valve.

14. The cooling system according to claim 1, further comprising an auxiliary circuit connected with said coolant circulation circuit, said auxiliary circuit containing one of an oil cooler and a transmission cooler.

15. The cooling system according to claim 1, wherein said control valve structure comprises an electrically actuated, three-way diverter valve disposed at a juncture of said by-pass circuit and said coolant circulation circuit.

16. The cooling system according to claim 8, wherein said valve in said heater circuit is movable between on and off positions.

17. An engine cooling system comprising:

an engine;

a radiator assembly including a radiator and a fan driven by a variable speed electric fan motor;

a radiator temperature sensor to detect a temperature indicative of a temperature at said radiator, a coolant circulation circuit interconnecting said engine and said radiator for circulating coolant;

a by-pass circuit connected to said coolant circulation circuit so that coolant may by-pass said radiator;

a heater circuit connected to the coolant circulation circuit;

a heater core in said heater circuit;

a valve in said heater circuit to control flow of coolant through said heater core;

an electrically powered variable speed coolant pump disposed in said coolant circulation circuit to pump coolant through said coolant circulation circuit, and control valve structure constructed and arranged to control a mass flow of coolant through said radiator;

a engine temperature sensor to detect a temperature of engine coolant; and a controller operatively connected with said coolant pump, said electric fan motor, said control valve structure, said heater valve, said engine temperature sensor, and said radiator temperature sensor to (1) selectively control said heater valve and said control valve structure, (2) control speed of said coolant pump based on signals received from said engine temperature sensor, and (3) control speed of said electric fan motor based on a signal received from radiator temperature sensor, thereby controlling an operating temperature of said engine to approach a target operating temperature, without monitoring actual speed or load of said engine.

18. A method of controlling an operating temperature of an engine, the engine having a cooling system including a radiator assembly including a radiator and a fan driven by an electric fan motor; a coolant circulation circuit interconnecting the engine and the radiator for circulating coolant; a by-pass circuit connected to the coolant circulation circuit so that coolant may by-pass the radiator; an electrically powered variable speed coolant pump disposed in the coolant circulation circuit to pump coolant through the coolant circulation circuit; control valve structure constructed and arranged to control mass flow of coolant through the radiator; an engine temperature sensor to detect a temperature of engine coolant; a radiator temperature sensor to detect a temperature indicative of a temperature at said radiator; and controller operatively connected the electric fan motor, the coolant pump, the control valve structure, the engine temperature sensor, and the radiator temperature sensor, the method including:

determining the temperature of coolant at the engine and comparing the coolant temperature with a target engine coolant temperature, based on a difference between said coolant temperature and said target engine coolant temperature, operating said control valve structure and controlling the coolant pump to control a mass flow rate of coolant though the radiator, thereby adjusting the operating temperature of the engine, determining an actual temperature of air exiting the radiator or coolant at an outlet of the radiator and comparing said actual temperature to a maximum target temperature; and based on a difference between said actual temperature and said maximum target temperature, controlling a speed of the electric fan motor to improve thermal performance of the radiator.

19. The method according to claim 18, wherein said radiator temperature sensor is constructed and arranged to detect a temperature of air exiting said radiator.

20. The method according to claim 18, wherein said radiator temperature sensor is constructed and arranged to detect a temperature of coolant at an outlet of said radiator.

21. The method according to claim 18, wherein values of said target engine coolant temperature and said maximum target temperature are stored in memory in said controller.

22. The method according to claim 18, further providing feedback relating to a speed of said coolant pump and a speed of the electric fan motor to indicated to the controller a present speed of said coolant pump and of the fan motor, respectively, the controller performing further control of the coolant pump and/or of the fan motor when the associated feedback indicates that further control thereof is necessary.

23. The method according to claim 18, wherein the cooling system further includes a heater circuit connected to the coolant circulation circuit; a heater core in the heater circuit; and a valve in the heater circuit to control flow of coolant through the heater core, the valve being operatively connected with the controller, the method including:

controlling the valve in the heater circuit to control flow of coolant through the heater core.

24. The method according to claim 18, wherein the controller receives engine knock data, the method including:

controlling the control valve structure to increase flow through the radiator to reduce engine temperature to eliminate knock.

25. The method according to claim 18, wherein the controller receives engine oil temperature data, the method including:

controlling the control valve structure to increase flow through the radiator to reduce engine temperature so as to lower engine oil temperature.

26. The method according to claim 18, further providing feedback relating to a position of the control valve structure to indicated to the controller a present position the control valve structure, the controller performing further control of the position of the control valve structure when the feedback indicates that further control is necessary.

27. The method according to claim 18, further providing feedback relating to a position of the valve in the heater circuit to indicated to the controller a present position of the valve in the heater circuit, the controller performing further control of the valve in the heater circuit when the feedback indicates that further control is necessary.

28. A method of controlling an operating temperature of an engine, the engine having a cooling system including a radiator assembly including a radiator and a fan driven by an electric fan motor; a coolant circulation circuit interconnecting the engine and the radiator for circulating coolant; a by-pass circuit connected to the coolant circulation circuit so that coolant may by-pass the radiator; an electrically powered variable speed coolant pump disposed in the coolant circulation circuit to pump coolant through the coolant circulation circuit; control valve structure constructed and arranged to control mass flow of coolant through the radiator; an engine temperature sensor to detect a temperature of engine coolant; a radiator temperature sensor to detect one of a temperature of air exiting the radiator and a temperature of coolant at an outlet of the radiator; and controller operatively connected the electric fan motor, the coolant pump, the control valve structure, the engine temperature sensor, and the radiator temperature sensor, the method including:

determining a rise in coolant temperature in the engine and comparing the temperature rise with a target rise in engine coolant temperature, based on a difference between said rise in coolant temperature and said target rise in engine coolant temperature, operating said control valve structure and controlling the coolant pump to control a mass flow rate of coolant though the radiator, thereby adjusting the operating temperature of the engine, determining an actual temperature of air exiting the radiator or a temperature of coolant at an outlet of the radiator and comparing said actual temperature to a maximum target temperature; and based on a difference between said actual temperature and said maximum target temperature, controlling a speed of the electric fan motor to improve thermal performance of the radiator.

29. The method according to claim 27, wherein values of said target rise in engine coolant temperature and said maximum target temperature are stored in memory in said controller.

* * * * *